US005099810A

United States Patent [19]

Borst

[11] Patent Number: 5,099,810

[45] Date of Patent: Mar. 31, 1992

[54] DEVICE FOR PRODUCING CONTROL SIGNALS IN TIMED RELATION TO THE ROTATION OF A SHAFT

[75] Inventor: Wolfgang Borst, Schwieberdingen, Fed. Rep. of Germany

[73] Assignee: Robert Bosch GmbH, Stuttgart, Fed. Rep. of Germany

[21] Appl. No.: 573,191

[22] PCT Filed: Feb. 27, 1988

[86] PCT No.: PCT/EP88/00146

§ 371 Date: Aug. 27, 1990

§ 102(e) Date: Aug. 27, 1990

[87] PCT Pub. No.: WO89/08186

PCT Pub. Date: Sep. 8, 1989

[51] Int. Cl.[5] ..... F02P 3/045; F02D 41/02

[52] U.S. Cl. ..... 123/414; 123/478

[58] Field of Search ..... 123/414, 415, 416, 417, 123/427, 478, 490

[56] References Cited

U.S. PATENT DOCUMENTS

| | | | |
|---|---|---|---|
| 3,943,898 | 3/1976 | Kiencke | 123/416 |
| 3,990,417 | 11/1976 | Tershak | 123/416 |
| 3,991,727 | 11/1976 | Kawai et al. | 123/478 |
| 4,164,926 | 8/1979 | Kindlmann | 123/415 |
| 4,262,643 | 4/1981 | Cavil et al. | 123/416 |
| 4,347,819 | 9/1982 | Roberts | 123/415 |
| 4,351,287 | 9/1982 | Shirasaki et al. | 123/609 |
| 4,467,763 | 8/1984 | Gillespie et al. | 123/414 |
| 4,494,509 | 1/1985 | Long | 123/416 |
| 4,787,354 | 11/1988 | Wilens et al. | 123/417 |

FOREIGN PATENT DOCUMENTS

| | | |
|---|---|---|
| 0138520 | 4/1985 | European Pat. Off. . |
| 1586013 | 3/1981 | United Kingdom . |

OTHER PUBLICATIONS

"Handbook of Operational Amplifier Circuit Design" by D. F. Stout et al., McGraw Hill Book Company.

*Primary Examiner*—Tony M. Argenbright

*Attorney, Agent, or Firm*—Walter Ottesen

[57] ABSTRACT

A device for controlling ignition and/or injection operations in a four-stroke internal combustion engine comprises a phase-locked loop (PLL) in which a frequency divider (14) divides the number of peaks of a triangular output waveform (w) by half the number of cylinders to produce a feedback signal which is compared in a phase comparator (10) with reference marks (BM) produced by a pulse generator associated on the engine crankshaft. The rotation of the crankshaft is thereby accurately divided into the required number of segments for the spark plugs of the individual cylinders. The speed-dependent capacitor ($C_n$) is charged or discharged upon an increase or decrease in speed (n) by means of a follower control (18), to adjust the output frequency of the waveform (w) so that it remains in synchronism with the reference marks (BM). The phase of the output waveform (w) is corrected upon an increase or decrease in speed (n) by the follower control (18) which either multiplies the current ($i_w$) to charge the output capacitor ($C_w$) rapidly in a fraction of the period of the waveform upon an increase in speed (n) or sets the current ($i_w$) at zero so that the output capacitor ($C_w$) temporarily holds its charge upon a decrease in speed (n).

10 Claims, 4 Drawing Sheets

DEVICE FOR PRODUCING CONTROL SIGNALS IN TIMED RELATION TO THE ROTATION OF A SHAFT

FIELD OF THE INVENTION

The invention relates to a device for producing control signals in timed relation to the rotation of a shaft, especially the crankshaft or camshaft of an internal combustion engine for triggering fuel ignition and/or fuel injection operations.

BACKGROUND OF THE INVENTION

Such a device is known from U.S. Pat. No. 3,943,898. In this known device, the reference mark resets a counter which counts pulses produced by a pulse generator at 1° intervals of rotation of the crankshaft of the internal combustion engine. The control signals are produced by a decoder connected to the output of the counter. The control signals are processed by a computer which produces trigger signals for triggering ignition sparks, the number of control signals being equal to the number of engine cylinders. The computer delays the trigger signals with respect to the control signals in accordance with engine operating parameters (engine speed, air intake pressure, cooling water temperature) in order to obtain the desired optimum ignition timing.

The European patent application EP-A 187,182 describes a "High resolution electronic ignition control loop circuit 22 including a voltage-controlled oscillator (VCO) and a digital phase comparator 24, which receives an input signal from a speed sensor together with a divided output signal from the VCO. A filter 26 lies between the phase comparator and the VCO. The speed is sensed from a wheel having a plurality of teeth. Therefore, the response time of the phase lock loop circuit 22 with its filter 26 does not create any problems, when one turn of the sensed wheel is monitored. However, the known circuitry is too slow in its response time, when reference marks are sensed.

An example of a voltage-controlled oscillator is disclosed in "Handbook of Operational Amplifier Circuit Design": McGraw-Hill, 1976, pages 21-5 to 21-10.

Such a device has the disadvantage that, due to its complexity and the large numbers of input parameters required, it does not lend itself to use as a stand-by or back-up system for carrying on the function of a control apparatus in the event of failure of a microprocessor in the latter.

SUMMARY OF THE INVENTION

The arrangement of the invention overcomes the above disadvantage. In particular, trigger signals for the ignition or injection operations for the individual cylinders of the internal combustion engine can be obtained from a single input signal (reference mark) produced once for each revolution of the crankshaft and in exact timed relationship with the rotation of the crankshaft. The angular movement of the crankshaft is divided into the desired equal sectors to produce control signals at the instant required for the respective signals. A separate pulse generator and associated counter as disclosed in U.S. Pat. No. 3,943,898 are not required. The phase relationship between the output signal and the input signal is fixed. A precise angular relationship between the peaks of the output waveform is possible. The correct frequency and phase relationship are obtained after each change in the frequency of the input signal (shaft speed). The PLL in the device of the present invention is especially suitable for low frequencies. The properties of the PLL are maintained over a very high frequency range, for example, 1 hertz to 250 hertz (60 r.p.m. to 15000 r.p.m.)

GB-A-15 86 013 illustrates the use of a conventional PLL in conjunction with an ignition system but it is used to derive fuel injection trigger pulses from ignition pulses and timing is not critical in the case of petrol injection into the intake manifold.

According to another feature of the invention, in which the control voltage for the VCO is obtained from a frequency determining capacitor and the output of the VCO is fed to an output capacitor, a triangular waveform can be obtained from the latter and the PLL responds rapidly to changes in the engine speed.

It is advantageous, if the time constants pertaining to the two capacitors are matched as any frequency adjustment consequent upon a speed change may take place during a single cycle.

According to still another feature of the invention, it can be ensured that the follower control of the PLL adjusts the frequency fully within a single period.

BRIEF DESCRIPTION OF THE DRAWINGS

The device of the invention for a multi-cylinder internal combustion engine is further described, by way of example, with reference to the accompanying drawings, wherein.

DESCRIPTION OF THE PREFERRED EMBODIMENTS OF THE INVENTION

Figure 1:
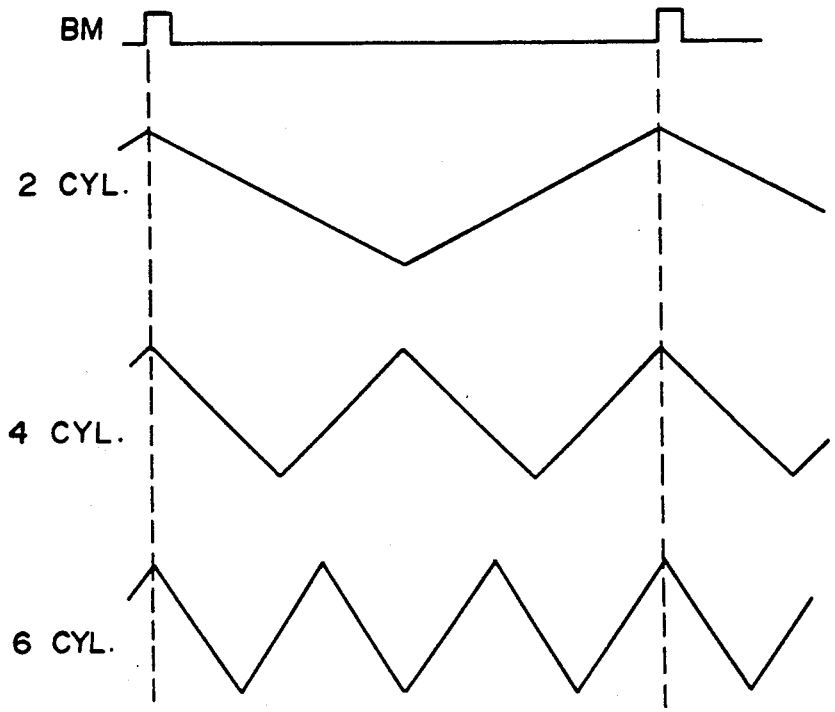
FIG. 1 is a pulse diagram showing the division of the angular intervals between reference marks into angular segments for various different numbers of cylinders.

In an ignition system for a multi-cylinder internal combustion engine, every two revolutions of the crankshaft, in the case of a four-stroke engine, must be equally divided by the number of cylinders to obtain desired instants of ignition shortly in advance of the TDC of each cylinder. This is represented in FIG. 1 where the positive peaks of triangular waveforms represent control signals for the desired instants of ignitiom in two, four, and six-cylinder, four-stroke engines in relation to a reference mark BM produced once per revolution of the crankshaft. Thus, for example, for a four-cylinder, four-stroke engine, two triangular waveform peaks must be produced at equal angular intervals for each reference mark BM.

The same applies to fuel injection systems for internal combustion engine, except that, in the case of petrol injection systems wherein the fuel is injected upstream of the engine inlet valves, timing is not critical.

Figure 2:
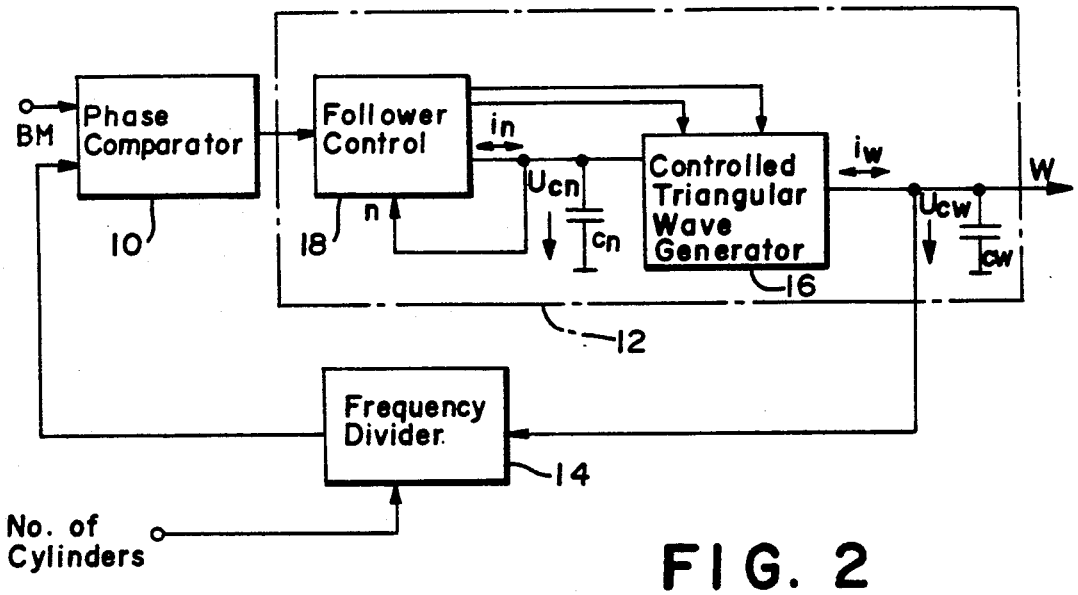
FIG. 2 is a block circuit diagram of a device according to the invention.

The phase-controlled phase-locked-loop (PLL) shown in FIG. 2 is designed to produce the triangular waveforms illustrated in FIG. 1. The reference mark BM, derived from a pulse generator (not shown) associated with the engine crankshaft, is fed to a reference input of a phase comparator 10. The latter produces an error signal dependent of the phase difference between the reference mark BM and a feedback signal fed to a feedback input of the comparator 10 and this error signal controls a voltage-controlled oscillator (VCO) 12 at whose output appears the triangular waveform w. The latter is also supplied to a frequency divider 14 which divides the waveform w by the number of peaks of the triangular waveform w per reference mark BM, i.e., by half the number of cylinders of the internal combustion engine. The output of the divider 14 is applied to the feedback input of the phase comparator 10. In the steady state, the PLL operates such that the output waveform w is a multiple of the frequency of the reference marks BM, such multiple being the reciprocal of the divider ratio of the frequency divider 14 and the output waveform w is in exact timed relationship to the reference marks BM.

The VCO 12 comprises a capacitor $C_w$ which is charged and discharged alternately by a current $i_w$ which is fed from a controlled triangular wave generator 16 and which is alternately positive and negative, whereby the triangular waveform w appears as the rising and falling voltage $U_{cw}$ on the capacitor $C_w$. The controlled triangular wave generator 16 is itself controlled by the voltage $U_{cn}$ on a capacitor $C_n$ and by a follower control 18 via lines 20. The magnitude of the current $i_w$ and the frequency of the waveform w are directly proportional to the voltage $U_{cn}$ on the capacitor $C_n$. The follower control 18 provides a current $i_n$ by which the capacitor $c_n$ is charged or discharged but, in the steady state, i.e., at constant engine speed n, the current $i_n$ is zero. The PLL is thereby enabled to achieve optimum control over the whole speed range of the engine, which may, for example, be 60 r.p.m. to 10,000 r.p.m. as is described more fully hereinafter. The information stored in the capacitor $C_n$ remains at the same correct value until new speed information arises at the phase comparator. This is of particular advantage at low engine speeds.

The triangular waveform w can be used to generate the instants of injection, the injected fuel quantity, the instants of ignition (ignition angle) and the duration of the current in the primary winding of the ignition coil. To this end, the triangular waveform w is processed, using simple voltage comparators whose switching voltages are adjusted in accordance with engine operating parameters, such as engine vacuum and cooling water temperature. The triangular waveform w inherently contains, as information, the engine speed.

In the case of an internal combustion engine having an odd number of cylinders, such as three or five, it is necessary to derive the reference marks from the rotation of the camshaft rather than the crankshaft or to suppress every other reference mark coming from the pulse generator. The divider must then divide the pulse frequency of the VCO by the number of cylinders, rather than half the number of cylinders.

Figure 3A:
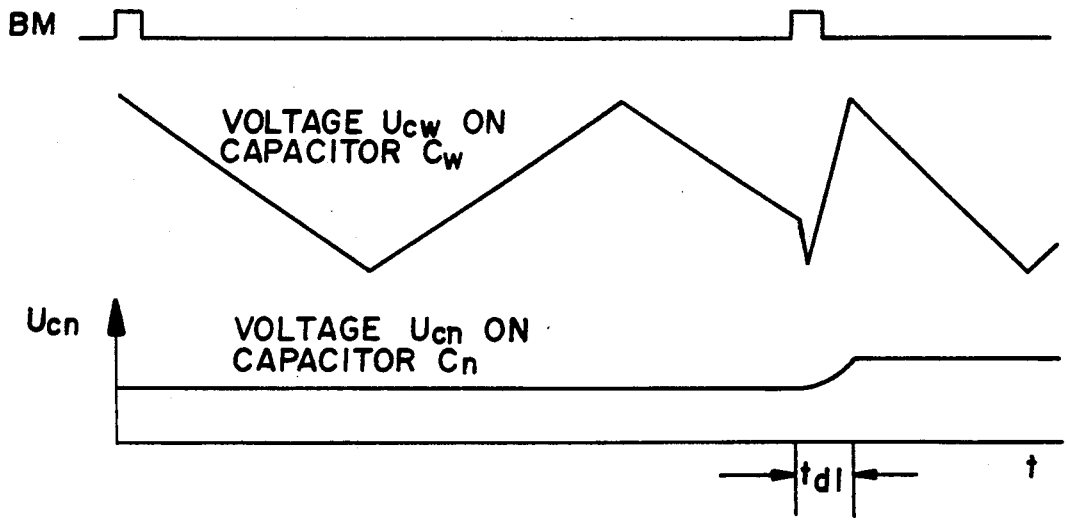
FIGS. 3*a* and 3*b* show the changes in the output triangular waveform for increasing and decreasing speed, respectively.

Upon acceleration of the engine, the triangular waveform w is momentarily of too low a frequency, as shown in FIG. 3*a*. The follower control 18 then causes the current $i_w$ of the controlled triangular wave generator 16 to be increased by a fixed multiple. The triangular waveform w is thereby brought rapidly to the correct phase over the short time interval $t_{d1}$. After the end of the time interval $t_{d1}$, the current $i_w$ which charges and discharges the capacitor $C_w$ is once again determined by the voltage $U_{cn}$ on the capacitor $C_n$. However, the charge on the frequency-determining capacitor $C_n$ is also increased during the same time interval $t_{d1}$, whereby the frequency of the triangular waveform w is increased.

The time interval $t_{d1}$ required for the triangular waveform w to be brought back into phase corresponds directly to the error at the PLL. The length of this time interval $t_{d1}$ is dependent on the value of the capacitor $C_w$ and on the multiplying factor, the latter being the amount by which the current $i_w$ is multiplied by the follower control 18. Since this time interval $t_{d1}$ is used also for the speed adaptor of the charge on the capacitor $C_n$, it is possible by a suitable choice of the time constants for the charge adjustment of the capacitor $C_w$ and the charging of the capacitor $C_n$, for the frequency to be exactly correct for the next period after the adjustment just effected. This can be achieved if both currents $i_w$ and $i_n$ are made simultaneously dependent upon speed, e.g. if both are derived from the voltage on the capacitor $C_n$. The frequency for the next period can always be made exactly correct if the magnitude of the triangular wave generator current $i_w$ varies directly proportionally to engine speed n and the follower control current $i_n$ is proportional to the square of the speed n. Thus, with increasing speed, the time required to adjust the frequency is reduced. For best results, the aforementioned multiplying ratio must also be chosen appropriately. The frequency wave of the PLL depends upon the value of the capacitor $C_w$ and the range of magnitude of the current $i_w$.

Figure 3B:
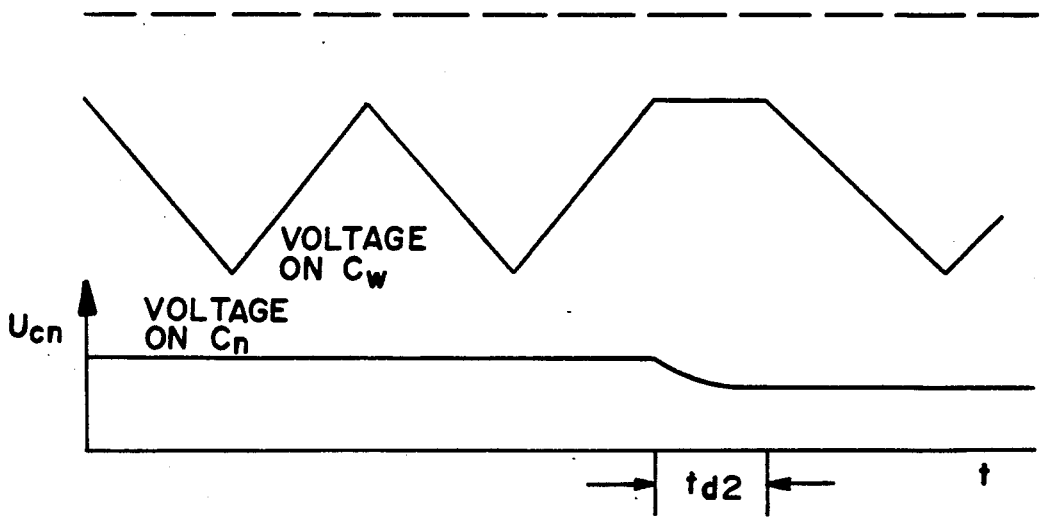

Upon a deceleration of the engine, the frequency of the triangular wave w is momentarily too high, as shown in FIG. 3*b*. The current $i_w$ of the triangular wave generator 16 is set to zero by means of the follower control 18 during a time interval $t_{d2}$. The peak voltage on the capacitor $C_w$ is thereby prolonged and over the same interval $t_{d2}$, the charge, and therefore the voltage, on the frequency determining capacitor $C_n$ is reduced. Again the follower control current $i_n$ for the capacitor $C_n$ must vary proportionally to the square of the engine speed.

FIGS. 4*a* to 4*c* and 5*a* to 5*c* demonstrate the rapid response of the PLL changes in frequency although, in practice, it is impossible for the crankshaft speed to double or to halve over a single revolution.

Figure 4A:
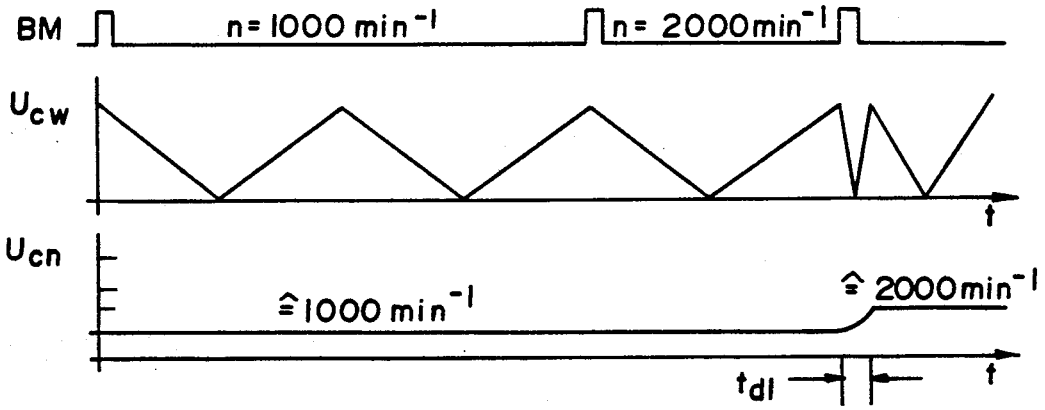
FIGS. 4*a* to 4*c* show the regulating operation upon doubling the input frequency over a single cycle.
Figure 4B:
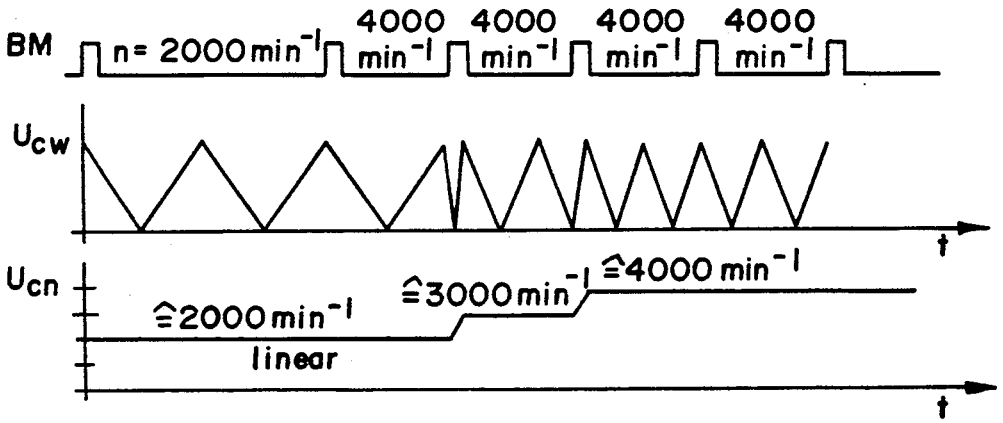
Figure 4C:
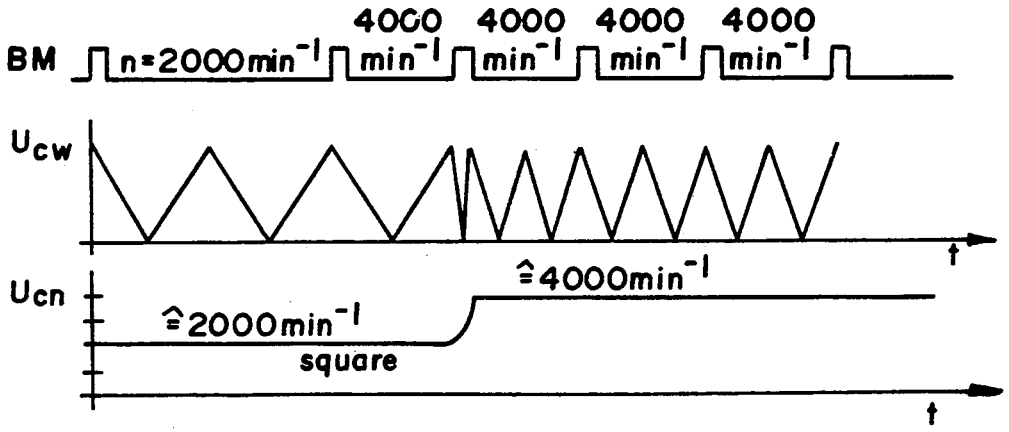

FIGS. 4*a* to 4*c* show a doubling of the shaft speed n from 1000 r.p.m. to 2000 r.p.m. The time constants have been so matched that the frequency of the output voltage $U_{cw}$ on the capacitor $C_w$ agrees with the speed n after only a single regulating operation over the time interval $t_{d1}$. FIGS. 4*b* and 4*c* show a doubling of the shaft speed n from 2000 r.p.m. to 4000 r.p.m. In FIG. 4*c* both the follower control current $i_n$ and the magnitude of the current $i_w$ for the capacitors $C_n$ and $C_w$ respectively vary linearly with speed and it can be seen that two regulating operations are needed to bring the frequency of the output waveform w into agreement with the speed n. In FIG. 4*c*, the follower control current $i_n$ for the capacitor $C_n$ varies according to the square of the speed n, as in FIGS. 3*a* and 4*a*, whereby the current $i_n$ is quadrupled.

The output frequency is here brought into line after a single regulation operation.

Figure 5A:
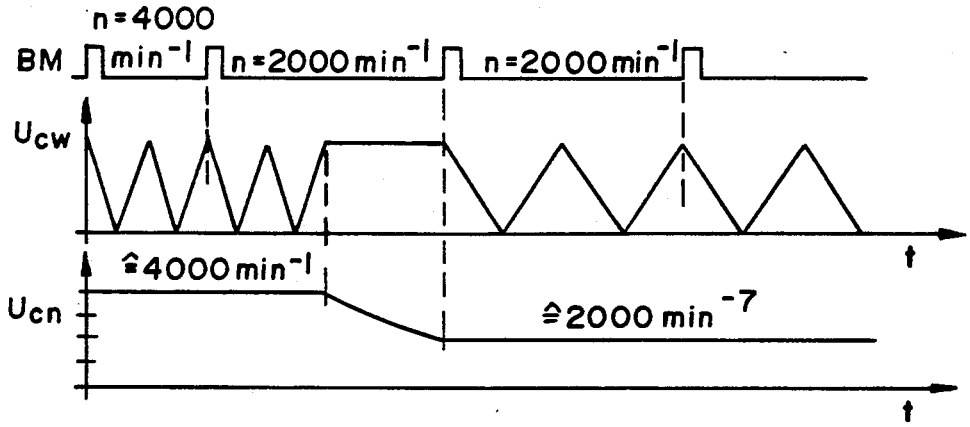
FIGS. 5*a* to 5*c* show the effects of halving the input frequency over a single cycle.
Figure 5B:
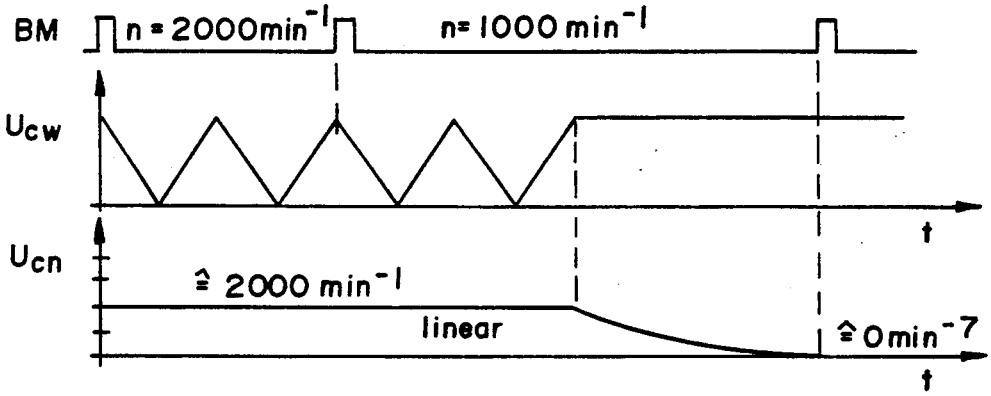
Figure 5C:
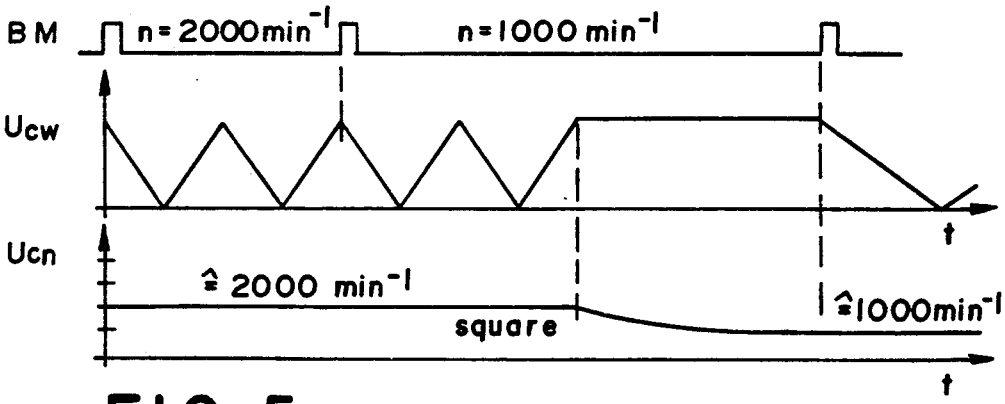

Similarly, as shown in FIGS. 5*a* and 5*c*, the output waveform w is brought into conformity with the shaft speed n over a single regulating operation, even when the speed n is halved from 4000 r.p.m. to 2000 r.p.m. and from 2000 r.p.m. to 1000 r.p.m. by varying the current $i_n$ in accordance with the square of the speed n. When the current $i_n$ is directly proportional to speed two regulating operations are entailed over a speed reduction from 2000 r.p.m. to 1000 r.p.m, as shown in FIG. 5*b*.

Although the voltage $U_{cn}$ is shown as falling in a straight line upon a reduction in engine speed, in practice the voltage $U_{cn}$ drops exponentially.

The drawings show a PLL useful in a stand-by device within a microprocessor—based engine arrangement system. Such a system is used to generate the signals for ignition and the signals for fuel injection.

In the PLL of the present invention, the controlling of the capacitor $C_n$ by the follower control is similar to the operation of an RC network in a conventional PLL to regulate the output frequency so that it conforms to the input frequency. In the PLL of the present invention the phase of the output waveform w is also corrected as well as its frequency. This provides for much better behaviour in speed regulation and, in addition, the phase relationship between input and output is always correct. The latter feature is particularly important for ignition as a conventional PLL is not able to provide the necessary correct phase relationship.

The PLL of the present invention can easily be incorporated in a microchip wherein it is easy to realize the above-mentioned quadratic relationship between the current $i_n$ and engine speed n to obtain the best speed regulation.

I claim:

1. An arrangement for producing control signals in timed relation to the rotation of a shaft of an internal combustion engine for triggering ignition operations, the arrangement comprising:

signal transducer means operatively connected with said shaft for producing a reference mark (BM);

a phase-locked loop including: a phase comparator having an input for receiving said reference mark (BM) and having an output; and, a voltage controlled oscillator for producing a sequence of control signals in response to said reference mark (BM);

said voltage controlled oscillator including a controlled wave generator having an output; an output capacitor $C_w$ connected to said output of said controlled wave generator for receiving a current $i_w$ from said wave generator for charging and discharging said capacitor to produce an output waveform (w); and, follower control means connected to said output of said comparator and being connected to said controlled wave generator for controlling said wave generator so as to cause the current $i_w$ produced thereby to be multiplied upon an increase in shaft speed to bring said output waveform (w) back into phase with said reference mark (BM).

2. The arrangement of claim 1, said wave generator being a triangular wave generator and said comparator having a feedback input, said arrangement further comprising a frequency divider connected to said output capacitor $C_w$ for dividing the frequency of said output waveform w by the number of control signals (BM) in said sequence and for forming a feedback signal and applying said feedback signal to said feedback input of said comparator.

3. The arrangement of claim 2, said phase-lock loop further including a frequency-determining capacitor $C_n$ which is charged and discharged by a current supplied by said follower control in accordance with changes in shaft speed (n) to produce a voltage $U_{cn}$ on said frequency-determining capacitor $C_n$ and said frequency-determining capacitor being connected to said wave generator for applying said voltage $U_{cn}$ thereto so as to charge and discharge the output capacitor $C_w$ with the current $i_w$.

4. The arrangement of claim 3, wherein the time constants of the circuits of the capacitors ($C_n$ and $C_w$) are so matched that the frequency adjustment caused by a change in speed (n) takes place within a single period of the reference pulses (BM).

5. The arrangement of claim 4, wherein said follower control provides a follower control current $i_n$ for charging and discharging said frequency-determining capacitor $C_n$; and, said follower control current $i_n$ for the frequency-determining capacitor $C_n$ is proportional to the square of the speed (n), whereas the current $i_w$ for the output capacitor $C_w$ is directly proportional to the speed (n).

6. An arrangement for producing control signals in timed relation to the rotation of a shaft of an internal combustion engine for triggering fuel injection operations, the arrangement comprising:

signal transducer means operatively connected with said shaft for producing a reference mark (BM);

a phase-locked loop including: a phase comparator having an input for receiving said reference mark (BM) and having an output; and, a voltage controlled oscillator for producing a sequence of control signals in response to said reference mark (BM);

said voltage controlled oscillator including a controlled wave generator having an output; and output capacitor $C_w$ connected to said output of said controlled wave generator for receiving a current $i_w$ from said wave generator for charging and discharging said capacitor to produce an output waveform (w); and, follower control means connected to said output of said comparator and being connected to said controlled wave generator for controlling said wave generator so as to cause the current $i_w$ produced thereby to be multiplied upon an increase in shaft speed to bring said output waveform (w) back into phase with said reference mark (BM).

7. The arrangement of claim 6, said wave generator being a triangular wave generator and said comparator having a feedback input, said arrangement further comprising a frequency divider connected to said output capacitor $C_w$ for dividing the frequency of said output waveform w by the number of control signals (BM) in said sequence and for forming a feedback signal and applying said feedback signal to said feedback input of said comparator.

8. The arrangement of claim 7, said phase-lock loop further including a frequency-determining capacitor $C_n$ which is charged and discharged by a current supplied by said follower control in accordance with changes in shaft speed (n) to produce a voltage $U_{cn}$ on said frequency-determining capacitor $C_n$ and said frequency-determining capacitor being connected to said wave generator for applying said voltage $U_{cn}$ thereto so as to charge and discharge the output capacitor $C_w$ with the current $i_w$.

9. The arrangement of claim 8, wherein the time constants of the circuits of the capacitors ($C_n$ and $C_w$) are so matched that the frequency adjustment caused by a change in speed (n) takes place within a single period of the reference pulses (BM).

10. The arrangement of claim 9, wherein said follower control provides a follower control current $i_n$ for charging and discharging said frequency-determining capacitor $C_n$; and, said follower control current $i_n$ for the frequency-determining capacitor $C_n$ is proportional to the square of the speed (n), whereas the current $i_w$ for the output capacitor $C_w$ is directly proportional to the speed (n).

* * * * *